United States Patent [19]

Turnbull

[11] 4,430,927

[45] Feb. 14, 1984

[54] HYDRAULIC VALVES

[75] Inventor: William S. Turnbull, Wolverhampton, England

[73] Assignee: Rubery Owen (Hydraulics) Limited, Wednesbury, England

[21] Appl. No.: 438,597

[22] Filed: Nov. 2, 1982

Related U.S. Application Data

[63] Continuation of Ser. No. 161,143, Jun. 19, 1980, abandoned.

[51] Int. Cl.[3] ..... F15B 13/08

[52] U.S. Cl. ..... 91/530; 91/436; 91/466; 137/596; 137/596.13; 137/596.2; 137/625.69; 137/884

[58] Field of Search ..... 91/436, 466, 530; 137/596, 596.12, 596.13, 596.2, 625.69, 884

[56] References Cited

U.S. PATENT DOCUMENTS

| | | | |
|---|---|---|---|
| 3,133,559 | 5/1964 | Tennis | 137/625.69 X |
| 3,134,402 | 5/1964 | Tennis | 137/596 |
| 3,151,630 | 10/1964 | Tennis | 137/596.2 |
| 3,194,265 | 7/1965 | Tennis | 137/596.12 X |
| 3,464,443 | 9/1969 | Tennis | 137/596.12 |
| 3,464,444 | 9/1969 | Tennis | 137/596.12 |
| 3,465,788 | 9/1969 | Tennis | 137/596.12 X |
| 3,718,159 | 2/1973 | Tennis | 137/596.12 |
| 3,722,540 | 3/1973 | Mazur et al. | 137/596 |
| 3,881,512 | 5/1975 | Wilke | 137/596.13 |
| 3,910,311 | 10/1975 | Wilke | 137/596.12 X |

*Primary Examiner*—Gerald A. Michalsky

*Attorney, Agent, or Firm*—Scrivener, Clarke, Scrivener and Johnson

[57] ABSTRACT

A sectional hydraulic valve has clamped together an inlet section, an outlet section and at least one working section which can be integral with the inlet and/or outlet sections. Fluid supply and return passages are formed in the sections and are in register at each junction where there are formed contiguous planar sealing surfaces. A depressed area is provided in one of the surfaces surrounding the contiguous planar sealing surfaces of the supply and return passages and a groove containing a sealing ring is formed in one of surfaces around the depressed area. A drain passage leading to a low pressure region opens into the depressed area and should there be leakage between the sealing surfaces of the supply and return passages, particularly as a result of the presence of high pressure in said passages, the leaked fluid merely passes into the depressed area and flows through the drain passage to the low pressure region without subjecting the sealing ring to pressure and possible leakage there past. In addition to the supply and return passages there may also be through passages formed in the sections and separated from the supply and return passages by additional contiguous planar sealing surfaces within the confines of the depressed area, leakage between these last mentioned surfaces being likewise drained away without subjecting the sealing ring to pressure.

10 Claims, 5 Drawing Figures

HYDRAULIC VALVES

This application is a continuation of application Ser. No. 161,143, filed June 19, 1980, now abandoned.

This invention relates to sectional hydraulic control valves for fluid pressure operated systems.

Sectional hydraulic control valves for fluid pressure operated systems comprise an inlet section, an outlet section and one or more working sections having co-operating fluid passages which are clamped together to form a single assembly. Fluid pressure seals have to be provided at the mating faces of the sections to prevent external leakage and to prevent internal leakage between registering passages in the various sections.

A fluid pressure sealing arrangement for such sectional valves is described in U.S. Pat. No. 3,133,559. In the arrangment described the sections have flat surfaces that intimately engage flat surfaces on the mating faces of adjacent sections around the ends of a supply passage made up of registering passages in each section. This provides high pressure surface seals to minimise leakage of high pressure fluid from the supply passage into the junctions between the sections. One of the sections at each junction has a shallow depression in its face that extends outwardly from and surrounds the adjacent high pressure surface seal. A tank return passage, made up of registering passages in each section, opens to each junction at a location outside the adjacent high pressure surface seal and to the depression which surrounds it. The depressions provide shallow low pressure spaces to receive any fluid leaking past the high pressure surface seals and from which spaces such leakage flows to the return passage. An annular sealing ring located in a groove in one of the faces surrounds each depression and because of the arrangement described it is intended that this ring is subject to low pressure only.

However, it is a consequence of this arrangement that any pressure generated in the tank return passage is applied over the full area of the depressions which are in communication with the tank return passage. Whilst this pressure may be small if the valve is composed of only one or two working sections it will be quite significant in a valve which has a large number of working sections, for example ten which is not unknown in valves of this type. In practice this pressure is frequently increased due to the presence of a filter in the return to tank line. It may be further increased by the presence of a restrictor or a back pressure (low pressure relief) valve fitted to reduce the incidence of cavitation in a hydraulic system in which the valve is fitted. The pressure seen at the depressions is further increased by the pressure drop occasioned by flow losses in the return to tank line. These fluctuate depending on the rate of flow of fluid and can be increased significantly when a higher than normal rate of flow of fluid occurs from a service to tank, for example from the full area side of an hydraulic jack subjected to a following load. For these reasons it will be seen that in practice the construction described results in fluctuating forces tending to separate the sections, the separation forces can rise to a high level and the sealing ring can be subjected to relatively high pressures.

In order to counteract this separating force which can cause internal and external leakage additional clamping force has to be applied and the latter may have the adverse effect of causing distortion of the sections whereby the valve spools are restricted in their freedom of movement, causing undesirably high operating forces for the valve spools.

According to the present invention, a sectional hydraulic control valve comprises an inlet section, at least one working section and an outlet section and means to clamp them together as an assembly in which mating faces of at least the inlet and working sections have corresponding passages in register with one another and isolated at the interface from the other passages by planar sealing surfaces, a depressed drain area or areas is provided in one of the mating faces adjacent the planar sealing surfaces, the passages and depressed area or areas are enclosed within a resilient sealing member in a groove in one of the mating faces of the adjacent sections, the depressed area or areas being in fluid communication with the groove and means to drain the depressed area or areas. The planar sealing surfaces may be separated from one another by the depressed area or areas.

It should be understood that a sectional valve comprehended by this invention includes a valve wherein there is but one working section which may be combined with either the inlet section or with the outlet section whereby the assembled valve comprises but two sections whose mating faces are as specified herein.

This invention will now be described by way of example with reference to the accompanying drawings in which.

Figure 5:
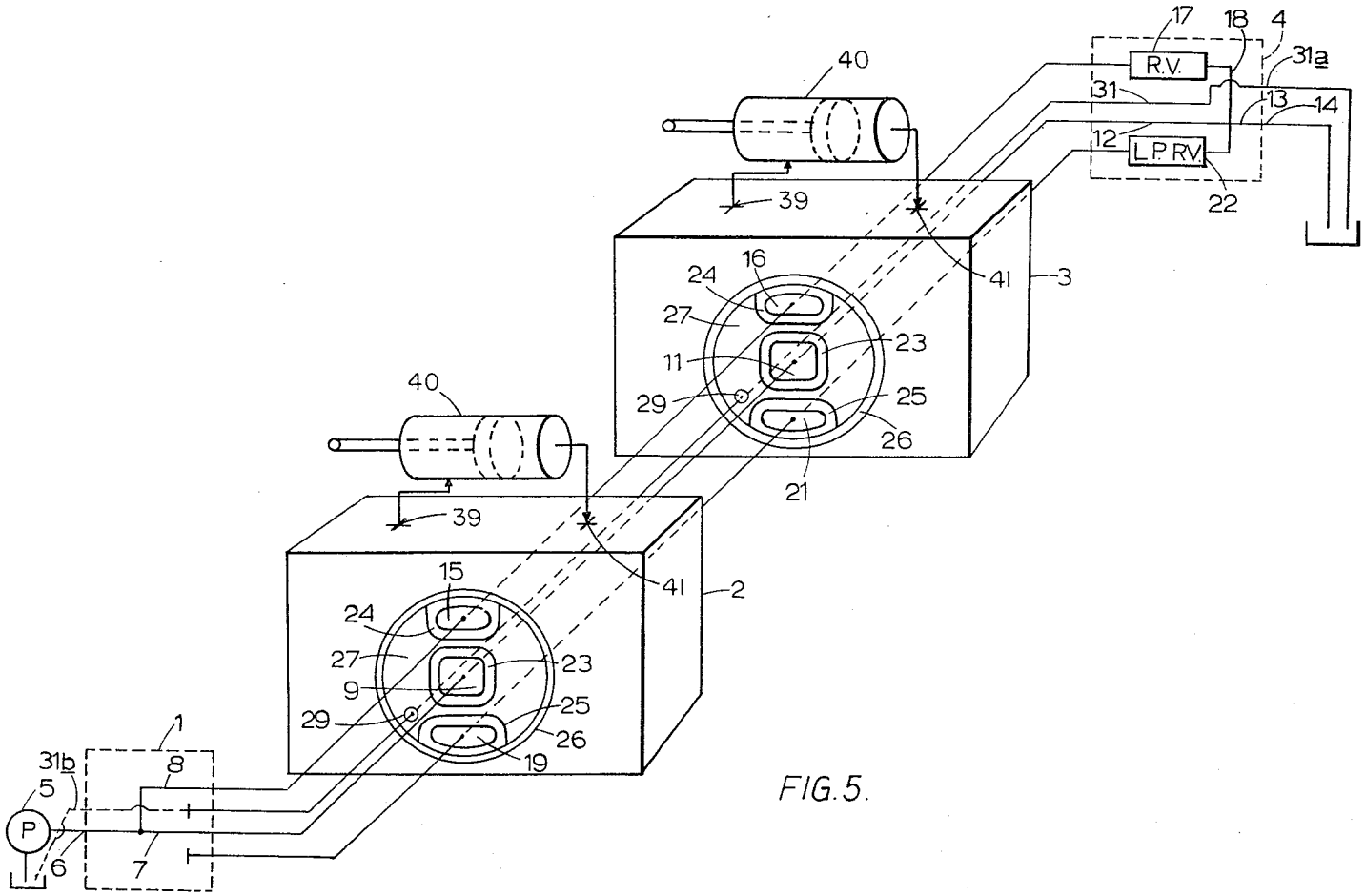
FIG. 5 is a block diagram of an hydraulic circuit of the valve.

Referring first to FIG. 5, an inlet section is illustrated in broken lines at 1, a first working section at 2, a second working section at 3 and an outlet section at 4. Hydraulic fluid supply from a pump 5 is supplied to an inlet connection 6 on section 1 and an internal passage in section 1 indicated at 7 leads the hydraulic fluid to an open centre passage 9 in section 2, whence it passes to a registering open centre passage 11 in section 3 and internal passages 12 and 13 in outlet section 4, terminating in an outlet connection 14 for connection to tank. This is the passage of hydraulic fluid when valve spools in sections 2 and 3 respectively are in their neutral positions, to be described later with reference to FIG. 1. Hydraulic fluid also passes successively through registering parallel supply passages 15 and 16 in sections 2 and 3 from passage 8 in section 1. Parallel supply passage 16 in section 3 connects with a main relief valve 17 in the outlet section 4 and the downstream side of the relief valve 17 is connected by a passage 18 to the passage 13. Registering tank return passages 19 and 21 in sections 2 and 3 pass hydraulic fluid returning from operated services to passage 13 in outlet section 4 via a low pressure relief valve 22 which is situated in outlet section 4.

Figure 3:
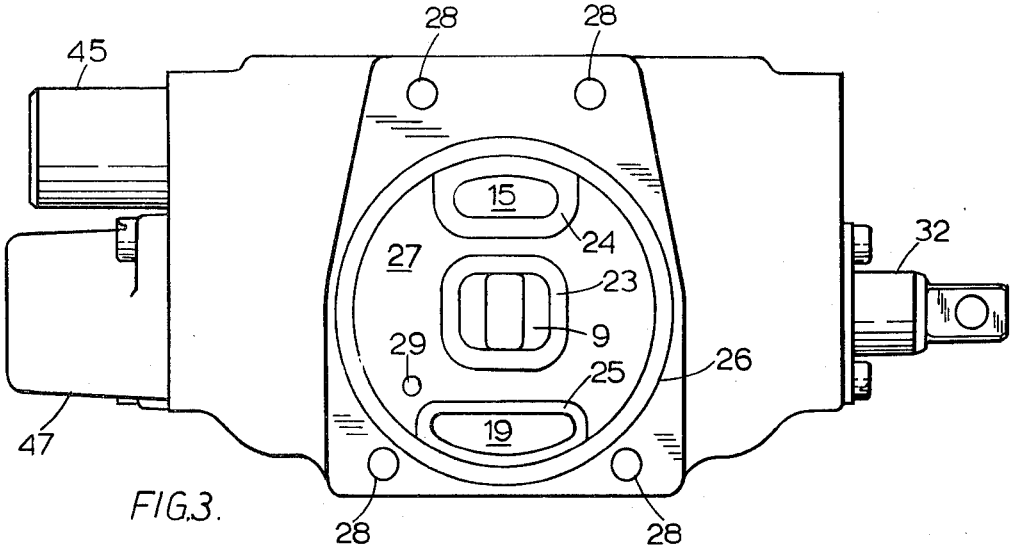
FIG. 3 is a view on a mating face of the valve section of FIG. 1.
Figure 4:
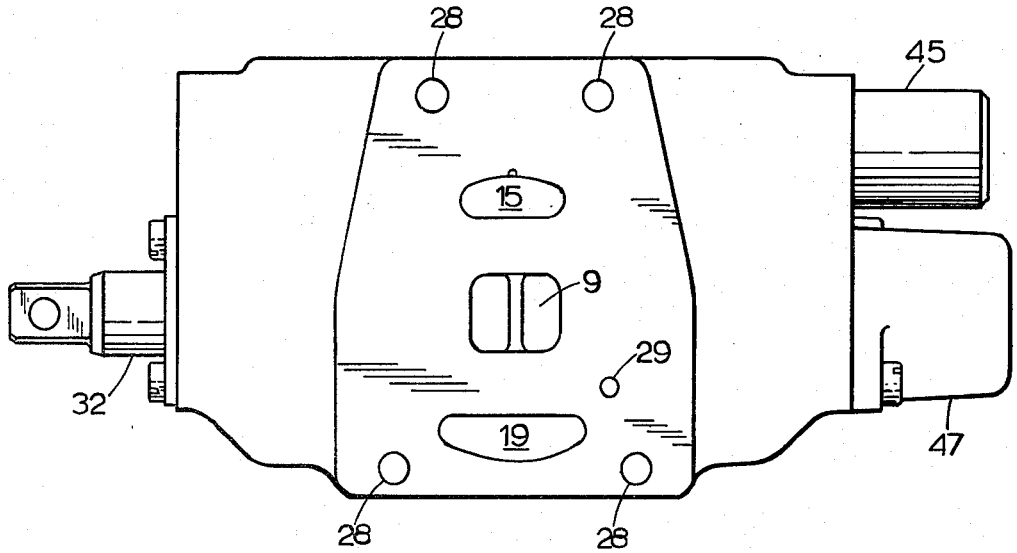
FIG. 4 is a view on the other mating face of the valve section of FIG. 1.

Referring now to FIG. 3 for which the same reference numerals will be used has have been used to describe the working section 2 of FIG. 5, the open centre, parallel supply and tank return passages 9, 15 and 19 respectively are shown. Flat machined faces 23, 24, 25 surround these passages and these faces mate with corresponding faces on the adjacent section of the valve and are shown in FIG. 4. FIG. 4 actually represents the face of the working section 2 opposite to that shown in FIG. 13 but also represents the face of the adjacent section in a valve assembly which will mate with and be clamped against the face shown in FIG. 3, when turned end to end.

A groove is machined in the face on the section 2 as at 26 to receive a rubber or like resilient sealing 'O' ring. A slightly depressed area indicated at 27 surrounds the sealing face 23 for the open centre passage 9 and partially encompasses the sealing face 24, 25 for parallel supply passage 15 and tank return passage 19. The depression 27 runs out into the 'O' ring groove at each side. It will be seen that when the valve is assembled with adjacent sections clamped to one another by bolts passing through holes at 28, the corresponding open centre, parallel supply and tank return passges are in register and each is isolated from the other passages and from the 'O' ring groove. A through hole 29 is drilled through the section from the area inside the depression between but to one side of the open centre and tank return passages. This hole 29 connects through the depressions with corresponding holes in the adjacent sections, except the inlet section when there is a planar sealing surface as indicated on FIG. 5, and terminates in a drain connection 31A in the outlet section via a passage 31, see FIG. 5. Where return to tank line losses are small the passage 31 may be connected to passage 13, that is, downstream of the low pressure relief valve 22.

It will be seen that in a sectional valve which incorporates a low pressure relief valve as 22, to cause a back pressure to develop in the tank return passage, that back pressure is now isolated from the depression 27 of each valve section and consequently cannot develop a force tending to separate the valve sections. Any leakage which may occur across the sealing face of any of the passages into the depression area drains through the holes 29 to the drain connection 31A or to passage 13 in the outlet section as the case may be and this passage 13 is on the downstream side of the low pressure relief valve 22.

For certain applications where it is desired to generate a back pressure in the tank return passage of one or more but not all the working sections of a sectional valve having a plurality of working sections, a restriction may be fitted in the tank return passage of one working section to pressurise the tank return passage of that section and the tank return passages of the preceding sections through which that tank return flow occurs. Generally, these sections will be those located between the section having the restriction and the inlet section. However, this is not necessarily so. If a high pressure carry over (e.g. to another valve) is provided at the outlet section the tank return flow may be reversed so that it leaves the valve via a tank port in the inlet section. In this arrangement, for example, if the restriction is fitted between the tank return passage of the working section adjacent the inlet section and the tank return passage of the adjacent working section, then this restriction will generate a back pressure in the tank return passages of all the sections except that one which is adjacent the inlet section.

Figure 1:
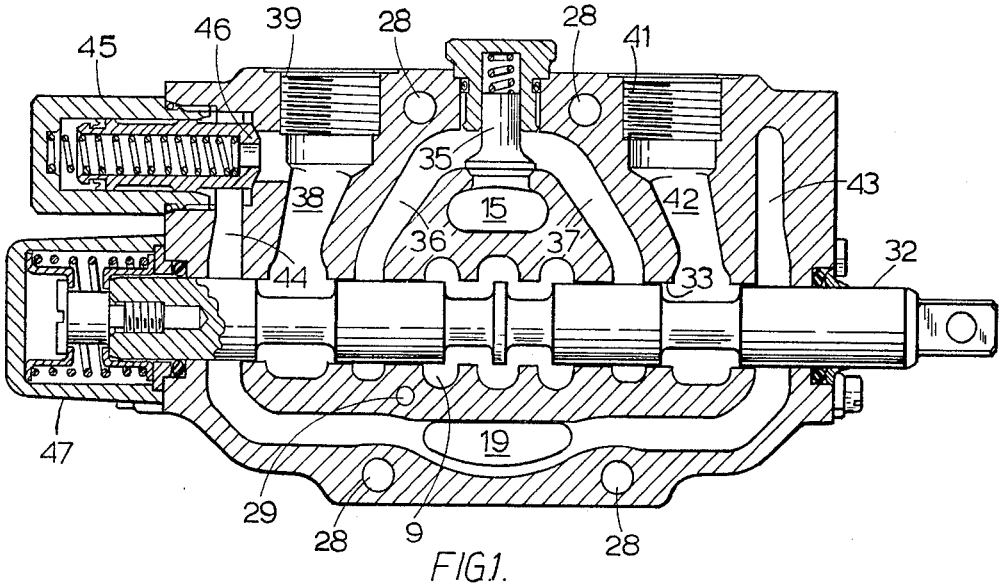
FIG. 1 is a cross-section of the working section of a sectional valve.
Figure 2:
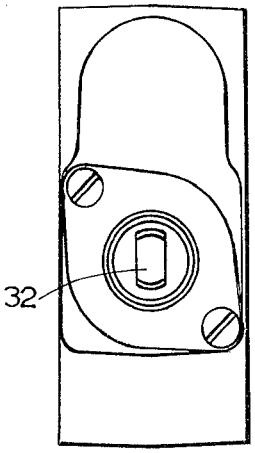
FIG. 2 is a view on the right hand end of FIG. 1.

Referring to FIG. 1, a spool 32 is shown in a bore 33. Fluid under pressure enters the section at parallel supply passage 15, passing upwardly through a check valve 35 and making pressure fluid available in passages 36 and 37. Movement of the spool 32 to the right from its neutral position (as shown) will cause hydraulic fluid under pressure to be supplied from the passage 36 to a service passage 38 and service port 39 connected to one side of a hydraulically operated device 40 as shown in FIG. 5.

This movement of the spool also connects a service port 41, connected to the other side of the device 40, to tank return passage 19 via service passage 42 and tank passage 43. At the same time lands on the spool 32 first restrict and then seal off the flow through the open centre passage 9. When the spool 32 is moved in the opposite direction the passages 37 and 42 are connected so as to supply pressure fluid to port 41 and the other side of device 40, whilst the first side thereof is connected through the port 39 and the service passage 38 to tank passage 44 which connects with tank return passage 19. An anti-cavitation valve is shown at 45, interposed between passages 38 and 44. If the pressure in passage 38 should fall below that in passage 44, for example when the spool 32 connects passage 36 to passage 38 and the demand of the service to which port 39 is connected exceeds the available pump flow so causing cavitation in passage 38, the valve member 46 of valve 45 will lift from its seat and connect passage 44 to passage 38. Fluid in the tank return and tank passages, maintained under pressure by valve 22, will now supplement the pump flow into the passage 38 and the service to which it is connected. A centring spring assembly is shown at 47, acting to bias the spool 32 into the neutral position in which free flow occurs through the open centre passage 9 and passages 38, 42 are isolated from passages 36, 44 and 37, 43 respectively.

Although the holes 29 have been described as draining to a drain connection or to a low pressure region in the outlet section 4, they could of course drain to a drain connection of a low pressure region elsewhere, for example in the inlet section, as is indicated in broken lines at 31B in FIG. 5.

The width (and consequently the area) of the flat machined surfaces 23, 24, 25 is desirably kept to a minimum consistent with providing a satisfactory seal so as to minimise the separation force occasioned by any leakage which may occur across these surfaces. As described and illustrated, the depression 27 separates the surfaces 23, 24, 25. However in a small valve or for other reasons, space constraints may be such that it is not practicable to arrange for the depression to separate these surfaces, or all of them, from one another in consequence of which some or all of them are co-extensive. Nevertheless the surface or surfaces isolate the relevant passages from the depression and the depression is maintained at a low pressure which is substantially atmospheric pressure.

It will be appreciated that in cases where a low pressure relief valve is not required in the tank return passage in the outlet section, and where a high pressure carry over (of the open centre supply passage to another valve) is not required then the open centre passage and tank return passage may be connected at the junction of the final working section and the outlet section. In such cases there is no requirement for planar sealing surfaces at this junction to isolate the open centre passage of the final working section from its tank return passage.

I claim:

1. A sectional hydraulic control valve comprising an inlet section, an outlet section and a working section, and means to clamp said inlet and outlet sections together with said working section therebetween, corresponding fluid supply and return passages formed in the sections, the supply and return passages in said working section registering respectively with the supply and return passages in the sections to which said working section is clamped, said working section and a section to which said working section is clamped having contiguous planar sealing surfaces including portions surrounding respectively the supply and return passages, a depressed drain area in one of said planar sealing surfaces within which are located the planar sealing surface portions surrounding the supply passages, and, isolated therefrom the planar sealing surface portions surrounding the return passages, a groove in one of said sealing surfaces enclosing and in fluid communication with said drain area, a resilient sealing member in said groove, drain passage means for draining said depressed are to a low pressure region of the valve, and registering open center passages formed in said sections, said contiguous planar sealing surfaces including portions surrounding said open center passages and located in said depressed drain area to isolate said open center passages from said supply and return passages.

2. The valve as in claim 1 wherein the planar sealing surface portions surrounding the return passages isolate said passages from said depressed drain area whereby pressure in said return passages is unable to act over the said depressed area to tend to separate said valve sections.

3. A sectional hydraulic control valve as claimed in claim 1, wherein the inlet, outlet and working sections are formed as separate sections and the junctions respectively between the inlet and working sections and between the outlet and working sections are each formed with said contiguous planar sealing surfaces, said depressed drain area, said groove in one of said sealing surfaces, said resilient sealing member in said groove, and said drain passages means to drain said depressed area to a low pressure region of the valve.

4. A valve as claimed in claim 3, including at least one additional working section clamped to said first working section, the junction therebetween being as at said junctions respectively between the inlet and its adjacent working section and the outlet and its adjacent working section.

5. A valve as claimed in claim 3, in which said drain passage means to drain the depressed areas comprises a series of communicating holes connecting said depressed areas to a low pressure region of the valve.

6. A valve as claimed in claim 5 in which said low pressure region is provided in said outlet section.

7. A valve as claimed in claim 5 in which said low pressure region is provided in said inlet section.

8. In an hydraulic circuit for the operation of at least one hydraulically actuated device, said circuit having a source of hydraulic fluid, hydraulic fluid pressure supply means extending from said source to said device for the supply of hydraulic fluid under pressure to said device and fluid pressure return means extending from said device to said source for exhausting of hydraulic fluid from said device to said source, a sectional control valve interposed between the fluid source and the device and comprising an inlet section, an outlet section and a working section, and means to clamp said inlet and outlet sections together with said working section therebetween, corresponding fluid supply and return passages formed in the sections of which the fluid supply passage is connected in the path of the fluid pressure supply means from the source to the device whilst the fluid pressure return passage is connected in the path of the fluid pressure return means from the device to the source, the supply and return passages in said working section registering respectively with the supply and return passages in the sections to which said working section is clamped, said working section and a section to which said working section is clamped having contiguous planar sealing surfaces including portions surrounding respectively the supply and return passages, a depressed drain area in one of said planar sealing surfaces within which are located the planar sealing surface portions surrounding the supply passages, and, isolated therefrom the planar sealing surface portions surrounding the return passages, a groove in one of said sealing surfaces enclosing and in fluid communication with said drain area, a resilient sealing member in said groove and drain passage means for draining said depressed area to a low pressure region of the valve.

9. In the circuit of claim 8, wherein the inlet, outlet and working sections of said control valve are formed as separate sections and the junctions respectively between the inlet and working sections and between the outlet and working sections are each formed with said contiguous planar sealing surfaces, said depressed drain area, said groove in one of said sealing surfaces, said resilient sealing member in said groove, and said drain passage means to drain said depressed area to a low pressure region of the valve.

10. In the circuit of claim 9, wherein said control valve includes at least one additional working section connected to a further hydraulically actuated device and clamped to said first working section, the junction therebetween being as at said junctions respectively between the inlet and its adjacent working section and the outlet and its adjacent working section.

* * * * *